US006185972B1

(12) United States Patent
Shore

(10) Patent No.: US 6,185,972 B1
(45) Date of Patent: Feb. 13, 2001

(54) ROLLING MILL FINISHING SECTION

(75) Inventor: T. Michael Shore, Princeton, MA (US)

(73) Assignee: Morgan Construction Company, Worcester, MA (US)

( * ) Notice: Under 35 U.S.C. 154(b), the term of this patent shall be extended for 0 days.

(21) Appl. No.: 09/495,224

(22) Filed: Jan. 31, 2000

Related U.S. Application Data

(60) Provisional application No. 60/123,873, filed on Mar. 11, 1999.

(51) Int. Cl.[7] ..... B21B 41/04
(52) U.S. Cl. ..... 72/228; 72/226
(58) Field of Search ..... 72/228, 231, 227, 72/234, 201, 366.2, 365.2, 200

(56) References Cited

U.S. PATENT DOCUMENTS

| | | | |
|---|---|---|---|
| 1,844,118 | 2/1932 | George . | |
| 3,625,043 | 12/1971 | Neumann et al. . | |
| 3,774,433 | 11/1973 | Pauels . | |
| 5,307,663 * | 5/1994 | Shore et al. | 72/228 |
| 5,325,697 | 7/1994 | Shore et al. . | |
| 5,345,805 | 9/1994 | Hauck . | |
| 5,577,405 | 11/1996 | Shore et al. . | |
| 5,634,257 | 6/1997 | Kajiwara et al. . | |
| 5,666,707 | 9/1997 | Cryderman et al. . | |
| 5,682,785 | 11/1997 | Müller et al. . | |
| 5,893,288 * | 4/1999 | Shore | 72/228 |

* cited by examiner

*Primary Examiner*—Rodney A. Butler
(74) *Attorney, Agent, or Firm*—Samuels, Gauthier & Stevens

(57) ABSTRACT

A method and apparatus for finish rolling long products such as bars, rods and the like, comprising: in a first operational mode, rolling the products through a finishing block and a reducing sizing mill arranged on a primary pass line; and in a second operational mode, diverting the products from the primary pass line to a secondary pass line bypassing the finishing block and then back to the primary pass line for rolling in the reducing sizing mill. Optionally and preferably, a cooling unit is shifted between the primary and secondary pass lines to cool products being rolled in each operational mode.

5 Claims, 1 Drawing Sheet

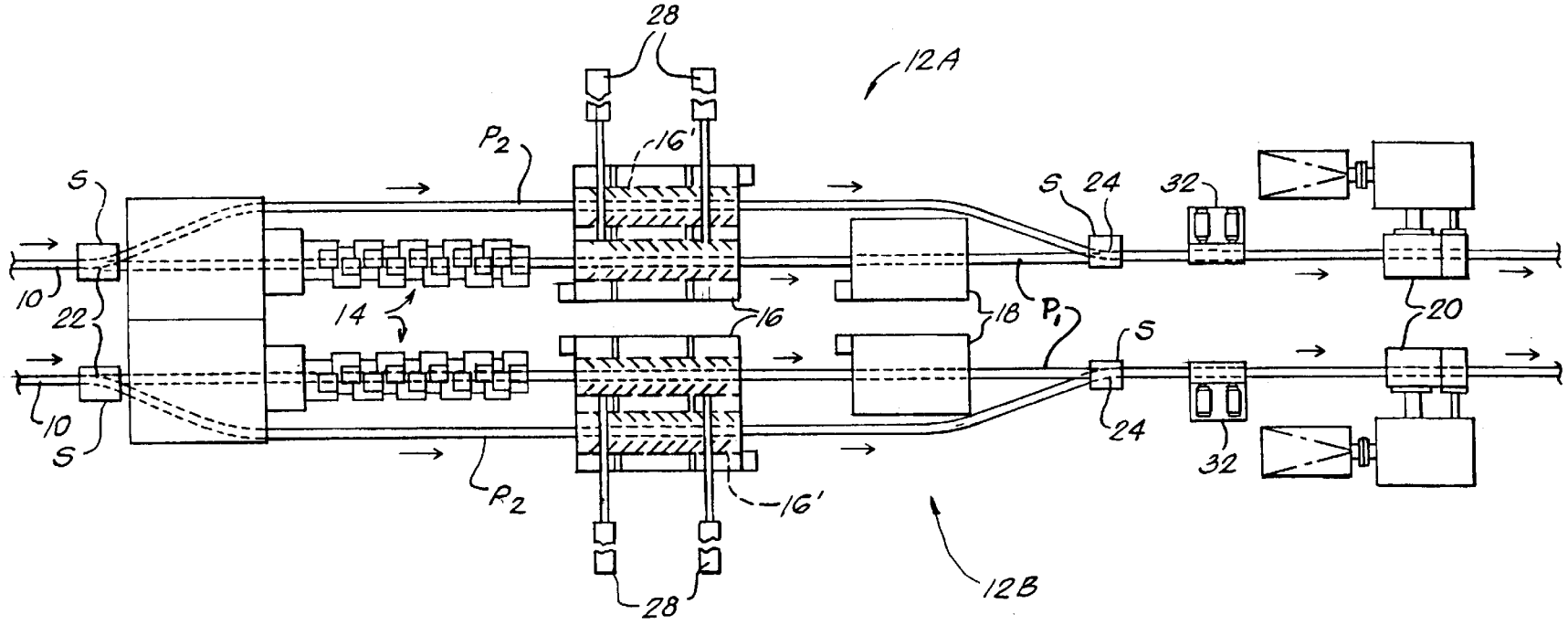
20
32
32
24
24
S
S
P1
18
12A
12B
16
16'
16'
28
28
P2
P2
14
S
S
22
10
10

ROLLING MILL FINISHING SECTION

PRIORITY INFORMATION

This application claims priority from provisional patent application Ser. No. 60/123,873 filed Mar. 11, 1999.

BACKGROUND OF THE INVENTION

1. Field of the Invention

This invention relates generally to continuous rolling mills for rolling long products such as bars, rods and the like, and is concerned in particular with an improved layout for the finishing section of such mills.

2. Description of the Prior Art

As shown for example in U.S. Pat. No. 5,325,697 (Shore et al.), the disclosure of which is herein incorporated by reference, it is known to roll products sequentially in finishing blocks and post finishing blocks (commonly referred to as "reducing sizing mills") arranged along a common primary pass line. Although this practice has many advantages which have resulted in its widespread commercial acceptance, one disadvantage stems from the inability to continue utilizing the reducing sizing mill while the upstream finishing block is being serviced or reconfigured to roll different products.

SUMMARY OF THE INVENTION

The present invention addresses this problem by providing a secondary pass line which diverges from the primary pass line at an upstream junction preceding the finishing block, and bypasses the finishing block, and then rejoins the primary pass line at a downstream junction preceding the reducing sizing mill. Switches at the upstream and downstream junctions are operable in one mode to direct products exclusively along the primary pass line for sequential rolling in both the finishing block and the reducing sizing mill. Alternatively, when the finishing block is out of service for various reasons, e.g., when dummying individual stands, for normal maintenance, etc., the switches may be operated to divert products along the secondary pass line and around the finishing block for rolling solely in the reducing sizing mill. Optionally and preferably, at least one water cooling unit is shiftable between the primary and secondary rolling lines for cooling the products being directed to the reducing sizing mill in both of the aforesaid operating modes.

BRIEF DESCRIPTION OF THE DRAWING

The accompanying drawing is a schematic plan view showing two rolling mill finishing sections in accordance with the present invention, one being arranged as a mirror image of the other.

DETAILED DESCRIPTION OF PREFERRED EMBODIMENT

Process sections that have already undergone rolling in upstream conventional roughing and intermediate mill sections (not shown) are directed along two parallel delivery paths 10 to two rolling mill finishing sections 12A, 12B each being arranged in accordance with the present invention, with one being a mirror image of the other.

Each finishing section includes a finishing block 14, water cooling units 16, 18 and a reducing sizing mill 20 arranged along a primary pass line $P_1$ aligned with a respective one of the delivery paths 10. The finishing block 14 includes a plurality of mechanically interconnected roll stands driven by a common drive and configured and arranged to roll products in a twist-free manner. One such finishing block is described in U.S. Pat. No. 5,577,405 (Shore et al.) the disclosure of which is herein incorporated by reference.

The reducing sizing mill 20 may be a so-called "post finishing block" as described in U.S. Pat. No. 5,325,697, where one or several light reduction round passes are preceded by a heavy reduction oval-round pass sequence, with the time interval between passes being sufficiently brief to avoid abnormal grain growth in the products being rolled.

Each finishing mill section 12A, 12B is further provided with a secondary pass line $P_2$ which departs from the primary pass line $P_1$ at an upstream junction 22 preceding the finishing block 14, and rejoins the primary pass line at a downstream junction 24 preceding the reducing sizing mill 20. The intermediate portion of each secondary pass line $P_2$ bypasses the respective adjacent finishing block 14. Switch mechanisms S located at the junctions 22, 24 are operable in a first mode to direct products along the primary pass lines $P_1$ for rolling in both the finishing blocks 14 and the reducing sizing mills 20. In a second operational mode, the switches S are operable to divert products from the primary pass lines $P_1$ to the secondary pass lines $P_2$ in order to bypass the finishing blocks 14 before returning to the primary pass lines for rolling solely in the reducing sizing mills 20.

Optionally and preferably, the water cooling units 16 are shiftable laterally along tracks 26 by any conventional means, e.g., piston-cylinder units 28. When positioned on the primary pass lines $P_1$, the water cooling units 16 are positioned to operate in concert with the downstream water cooling units 18 to cool the products emerging from the finishing blocks 14 before they are subjected to continued rolling in the reducing sizing mills 20. When shifted to the positions indicated at 16', the water cooling units lie on the secondary pass lines $P_2$ where they again operate to cool the products bypassing the finishing block before they are rolled in the reducing sizing mills.

Cobble and crop shear units 32 may be located between the downstream junctions 24 and the reducing sizing mills 20. Products emerging from the reducing sizing mills are directed to conventional controlled cooling and handling systems (not shown).

With the above described layout, in one operational mode, products can be rolled sequentially in the finishing blocks 14 and reducing sizing mills 20. In another operational mode, when the finishing blocks are out of service, larger diameter products can continue to be rolled in the reducing sizing mills 20. In either case, if desired, lower temperature thermomechanical rolling can be carried out in the reducing sizing mills by properly positioning the water cooling units 16.

I claim:

1. A rolling mill finishing section for rolling long products such as bars and rods, comprising:

a finishing block and a reducing sizing mill arranged sequentially along a primary pass line;

a secondary pass line departing from said primary pass line at an upstream junction preceding said finishing block, said secondary pass line bypassing said finishing block to rejoin said primary pass line at a downstream junction preceding said reducing sizing mill;

switch mechanisms at said junctions, said switch mechanisms being operable in a first mode to direct products along said primary pass line for rolling in both said finishing block and said reducing sizing mill, and being operable in a second mode to direct products initially along said secondary pass line to bypass said finishing block and then to return said products to said primary pass line for rolling in said reducing sizing mill; and a water cooling unit located between said upstream and downstream junctions, and means for shifting said water cooling unit between said primary and secondary pass lines to cool products being rolled in each of said modes.

2. The rolling mill finishing section of claim 1 further comprising a cobble and crop shear unit located on said primary pass line between said downstream junction and said reducing sizing mill.

3. The rolling mill finishing section of claim 1 further comprising a second cooling unit on said primary rolling line at a location spaced from both said first mentioned water cooling unit and said downstream junction.

4. The rolling mill finishing section of claim 1 combined with a second identical rolling mill finishing section, the said two finishing sections being arranged as mirror images of each other.

5. A method of finish rolling long products such as bars and rods, comprising:

in a first operational mode, rolling said products through a finishing block and a reducing sizing mill arranged on a primary pass line;

in a second operational mode, diverting said products from said primary pass line to a secondary pass line bypassing said finishing block and then back to said primary pass line for rolling in said reducing sizing mill; and shifting a water cooling unit between said primary and secondary pass lines to cool products being rolled in each of said operational modes.

* * * * *